United States Patent [19]

Chamberland et al.

[11] Patent Number: 4,690,482

[45] Date of Patent: Sep. 1, 1987

[54] HIGH FREQUENCY, HERMETIC, COAXIAL CONNECTOR FOR FLEXIBLE CABLE

[75] Inventors: Roger R. Chamberland, Oakdale; Andrew J. Stanland, Niantic, both of Conn.

[73] Assignee: The United States of America as represented by the Secretary of the Navy, Washington, D.C.

[21] Appl. No.: 881,366

[22] Filed: Jul. 7, 1986

[51] Int. Cl.[4] ..... H01R 17/18

[52] U.S. Cl. ..... 439/578; 439/283

[58] Field of Search ..... 339/177 R, 177 E, 94 R, 339/94 M, 94 A, 94 C, 143 R; 174/122 G, 50.58

[56] References Cited

U.S. PATENT DOCUMENTS

| | | | |
|---|---|---|---|
| 3,721,943 | 3/1973 | Curr | 339/94 M |
| 4,231,003 | 10/1980 | Ishimaru | 339/94 A |
| 4,420,210 | 12/1983 | Karol et al. | 339/94 M |
| 4,545,637 | 10/1985 | Bosshard et al. | 339/177 E |
| 4,556,271 | 12/1985 | Hubbard | 339/94 C |
| 4,593,758 | 6/1986 | Kyle | 174/50.58 |

*Primary Examiner*—Gil Weidenfeld
*Assistant Examiner*—David Pirlot
*Attorney, Agent, or Firm*—Michael J. McGowan; Arthur A. McGill; Prithvi C. Lall

[57] ABSTRACT

An hermetic, pressure proof coaxial connectors for flexible cables. A small connector with SMA mating configuration accepts dielectric diameters to 0.187" while a larger connector with TNC mating configuration accepts up to 0.375". These connectors provide a low VSWR and RF attenuation to 18.0 GHz.

2 Claims, 9 Drawing Figures

HIGH FREQUENCY, HERMETIC, COAXIAL CONNECTOR FOR FLEXIBLE CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to coaxial connectors and more particularly to a high frequency, hermetically sealed coaxial connector for use with small diameter flexible cables.

(2) Description of the Prior Art

Currently, there are no coaxial connectors available that are pressure proof to the center conductor, useable with flexible coaxial cables having 0.187 inch or 0.375 inch dielectric diameters, of small size, and provide (RF) electrical performance for frequencies up to 18.0 GHz. Miniature, glass fused SMA connectors exist that accept small diameter (0.141 inch) semirigid coaxial cable with a solid jacketed outer conductor, but can not be used with flexible cable. D. G. OBrien Inc., of Seabrook, NH, makes a coaxial plug-receptacle connector assembly for RG-58 size flexible coaxial cable, but frequency coverage is only up to 2GHz and connector size is prohibitively large. High frequency coaxial connectors are not available that accept small diameter flexible coaxial cables and that offer pressure integrity to the center conductor.

SUMMARY OF THE INVENTION

Accordingly, it is a general purpose and object of the present invention to provide a connector for small diameter, flexible, coaxial cable. It is a further object that the connector be hermetically sealed. Another object is that the connector accommodate frequencies up to 18.0 GHz. A still further object is that the connector provide pressure integrity to the center conductor.

These objects are accomplished with the present invention by providing a hermetically sealed, pressure-proof, coaxial connector for small diameter flexible coaxial cables. A receptacle configuration and a matching plug configuration engageably interconnect to form a connector. Connector size (diameter) may be varied to conform to industry standard coaxial cable sizes and connector mating configurations. A smaller connector with SMA mating configuration would accept dielectric diameters to up 0.187" while a larger connector with TNC mating configuration would accept up to 0.375" diameter. Such connectors provide a low VSWR and RF attenuation to 18.0 GHz.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figures 1, 1A, 2, 3, 4, 5, 6, 7, 8:
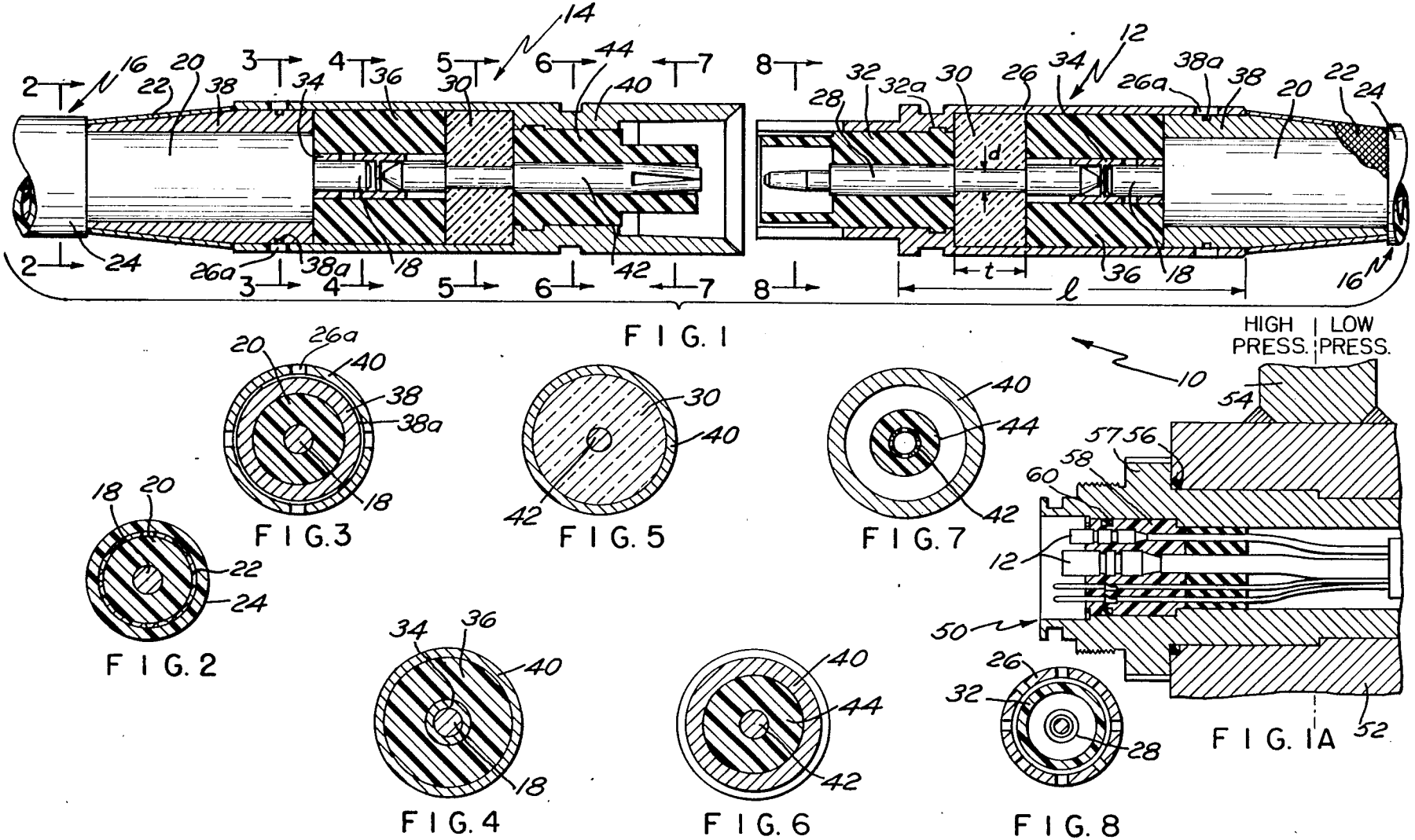
FIG. 1 shows a longitudinal, cross-sectional view of a coaxial connector according to the teachings of the present invention.
FIG. 1A shows a multi-connector arrangement including connectors according to FIG. 1 passing through a high pressure bulkhead.
FIG. 2 shows a cross-sectional view of the connector of FIG. 1 taken along section 2—2 thereof.
FIG. 3 shows a cross-sectional view of the connector of FIG. 1 taken along section 3—3 thereof.
FIG. 4 shows a cross-sectional view of the connector of FIG. 1 taken along section 4—4 thereof.
FIG. 5 shows a cross-sectional view of the connector of FIG. 1 taken along section 5—5 thereof.
FIG. 6 shows a cross-sectional view of the connector of FIG. 1 taken along section 6—6 thereof.
FIG. 7 shows a cross-sectional view of the connector of FIG. 1 taken along section 7—7 thereof.
FIG. 8 shows a cross-sectional view of the connector of FIG. 1 taken along section 8—8 thereof.

Referring now to FIG. 1 there is shown a high frequency, hermetically sealed, coaxial cable connector assembly 10 according to the present invention. Assembly 10 further comprises a plug 12 and a receptacle 14, each of which selectively provides a termination for an end of a coaxial cable 16. A typical coaxial cable 16 has a round center conductor 18 which is covered by a cylindrical coaxial dielectric material 20. Over material 20 is disposed a second conductor 22 of metal braid, which braid is in turn covered by an outer cylindrical plastic jacket 24. Fixedly attached to such coaxial cable ends are a plug 12 and a receptacle 14 which when engaged together form a coaxial connector 10. Plugs 12 and receptacles 14 may be used singly or as part of multi-pin asemblies.

Plug 12 further comprises a first body 26 having concentrically positioned therein a first metal pin 28 which is held fixedly in place by a cylindrical fused glass insert 30. Glass insert 30 has its outside diameter heat fused to the inside diameter of body 26 nearest to the coaxial cable and also has its inside diameter heat fused to pin 28. Insert 30 is of thickness "t" which is made as thin as possible yet strong enough to hermetically seal and structurally support the desired axial open face pressure. The diameter "d" of pin 28 in contact with insert 30 is undercut such that, in conjunction with the dielectric properties of the glass used, a constant impedance value matching that of the attached coaxial cable is maintained. Typically a value of 50 ohms is used for small diameter flexible coaxial cables. Body 26 may have one or more access holes **26*a*** formed therethrough at the cable end thereof if desired. The body thus includes a fused glass insert that provides the pressure boundary for the center conductor to body inside diameter. The center conductor is generally sized for a 50 ohm impedance based on the dielectric constant of the glass for the frequency range considered. The connector design will accept glass whose dielectric constant varies between 3.8 and 6.5.

A first cylindrical plastic insulator 32 of teflon or the like is press fit on the front end of pin 28, insulator 32 having an annular protrusion **32*a* which is force fit in body 26. A metal sleeve 34, having a thin internal wall to retain solder, slideably connects the rear end of pin 28 to conductor 18 while a second plastic cylindrical insulator 36 encloses sleeve 34 and is itself housed within body 26, one face thereof being in contact with glass insert 30 and the opposite face contacting cable dielectric 20. A tapered body adapter 38 is butted against one face of insulator 36 while within body 26 and tapers back a preselected distance beyond body 26 to provide support for braid 22 of cable 16. A circular groove 38***a* may be provided around adapter 38 which is then used in conjunction with holes 26*a* in body 26 to form a solder joint. Alternately, a 0.002–0.004 inch clearance may be provided between body 26 and adapter 38 for such a solder joint. The front end of pin 28 has a tapered nose which extends beyond front insulator 32 but remains within the end plane of body 26. Sleeve 34 is soldered to conductor 18 and braid 22 is soldered to body 26. The length "l" of body 26 is selected so as to maintain pressure integrity.

Receptacle 14, is identical to plug 12 in most respects except for the female end portion which mates with male plug 12. Receptacle 14 further comprises a second body 40 having concentrically positioned therein a second metal pin 42 which is held fixedly in place by cylindrical fused glass insert 30. A third cylindrical plastic insulator 44 of teflon or the like is press fit on the front end of pin 42. Metal sleeve 34 slideably connects the rear end of pin 42 to cable center conductor 18 while a fourth cylindrical insulator 46 encloses sleeve 34 and is itself housed within body 40, one face thereof being in contact with glass insert 30 and the opposite face contacting cable dielectric 20. A tapered body adapter 38 is butted to one face of insulator 46 while within body 40 and tapers back a preselected distance beyond body 40 to support braid 22 of cable 16. The front end of pin 42 has a hollow nose which extends beyond front insulator 44 but remains within the end plane of body 40. Sleeve 34 is soldered to conductor 18 and braid 22 is soldered to body 40.

FIG. 1A shows a multi-pin pressure bulkhead assembly 50 which installs in a sleeve 52 which has been welded in a bulkhead 54 separating a high pressure space from a low pressure space. Assembly 50 is sealably attached to sleeve 52 by means of 'O' ring 56 which seats against a flange on body 57 of bulkhead assembly 50. A plurality of plugs 12 are held in place in body 57 by means of insulator 58 which is sealed by 'O' ring 60. The high pressure is thus distributed over the face of each plug 12 or receptacle 14 used in assembly 50.

FIGS. 2 through 8 show detail cross sections of plug 12 and receptacle 14 at selected points to aid in visualizing the structure of the assemblies.

Since the cable and connector preparation are similar for each size connector and connector sex (plug or receptacle) the assembly procedure steps are described for attaching a plug 12 to a coaxial cable.

| | |
|---|---|
| Step 1 | Trim cable jacket 24 back a preselected length. |
| 2 | Comb out braid 22 and fold away. |
| 3 | Cut cable dielectric 20 away a preselected length. |
| 4 | Tin center conductor 18. |
| 5 | Solder adapter sleeve 34 to center conductor 18. |
| 6 | Slide body adapter 38 over cable dielectric 20 until flush with the cut end of cable dielectric 20. |
| 7 | Slide teflon insulator 36 over adapter sleeve 34. |
| 8 | Slide completed assembly into rear end of connector body 26 until insulator 36 has bottomed against insert 30. |
| 9 | While holding the assembly in the bottomed position, solder body adapter 38 to connector body 26. |
| 10 | Fold braid 22 forward over body adapter 38 and cut off excess braid that touches connector body 26. |

-continued

| | |
|---|---|
| 11 | Solder cable braid 22 to body adapter 38. |

The connector components are sized and the assembly designed for butt joints between insulators to avoid air gaps which result in capacitive discontinuities (impendance mismatches) in the assembled condition in order to to achieve optimal electrical performance, especially at higher frequencies.

The advantages of the present coaxial connector are its adaptability to flexible coaxial cable, its small size, and its extended (RF) frequency coverage to 18.0 GHz. Current coaxial connectors do not exist that combine the unique features of minimum size, high frequency performance, open face pressure proof integrity, and usability for various diameter flexible coaxial cables. The invention combines all these features with standardized mating configurations of either SMA or TNC. Its small size and rugged construction permit it to be used as a component in marine outboard cable assemblies and hull penetrations.

What has thus been described is a hermetic, pressure proof coaxial connector for flexible cables. A small connector with SMA mating configuration accepts dielectric diameters to 0.187" while a larger connector with TNC mating configuration accepts up to 0.375". These connectors provide a low VSWR and RF attenuation to 18.0 GHz.

Obviously many modifications and variations of the present invention may become apparent in light of the above teachings. For example: The connector internal dimensions can be changed to accept a lower glass dielectric constant, and/or a range of cable dielectric constants for varying materials, such as polyethylene, teflon, air-teflon, or spline type designs. The connector body outside diameter can be made pressure proof in a multipin assembly by various methods, such as adhesive bonding, laser welding, encapsulating or by using an "O-ring" to seal between the body and the surrounding material. A variety of metals can be used for the body and center conductor as long as they are compatible with the fused glass. Maximum electrical conductivity is achieved by gold plating after the fusing operation.

In light of the above, it is therefore understood that within the scope of the appended claims, the invention may be practiced otherwise than as specifically described.

What is claimed is:

1. A coaxial connector for shieldably joining together one end each of a first and second flexible coaxial cable, each said cable having identical impedance and a diameter no greater than 0.375 of an inch, comprising:

plug means, fixedly attached to said first coaxial cable, for providing a male ended cable termination having an impedance corresponding to said first coaxial cable, said plug means further comprising a first hollow, cylindrical body having a cable end and a connector end and first and second coaxial internal bores of different diameter, such that said first bore of smaller diameter extends a preselected depth into said first body from said connector end and said second bore of larger diameter extends a preselected depth into said first body from said cable end, a first internal body shoulder being formed where said first and second bores meet, a first cylindrical metal pin, concentrically positioned within said first body, said first pin having a length substantially greater than the diameter thereof and an undercut of preselected length formed thereupon at a preselected location along the length thereof thereby forming first and second pin shoulders, and further having first and second tapered ends, said first tapered end aligning with said first body connector end and said first pin shoulder aligning with said first body shoulder, for providing an electrically conducting path therethrough, a first fused glass cylindrical insert, having a preselected thickness, a cable end surface, a connector end surface and a dielectric constant, said first insert being heat fused to said second bore, said first body shoulder and said first pin undercut, for providing axial open-face pressure strength and hermetically sealing said plug means, a first cylindrical plastic insulator, press fit on said connector end of said pin and contacting the periphery of said first bore and the connector end surface of said first insert, a first metal sleeve, slideably engaing said second tapered end of said first metal pin and soldered to the central conductor of said coaxial connector, for providing electrical conduction therebetween, a second cylindrical plastic insulator, positioned within said first body over said first sleeve and contacting said second bore, contacting the cable end surface of said first insert and contacting the cable dielectric, for providing an impedance matching that of said cable, and a first tapered metal adapter, inserted within and fixedly attached to said second bore and being soldered to the outer metal braid of said coaxial cable, for providing support for said braid and electrical conductivity; and receptacle means, fixedly attached to said second coaxial cable, for providing a female ended cable termination having an impedance corresponding to said second coaxial cable;

said male and female ends being slideably engagable with one another such that when coupled together a coaxial, first cable-to-second cable joint is formed having a continuous impedance corresponding to that of said first and second coaxial cables.

2. A connector according to claim 1 wherein said receptacle means further comprises:

a second hollow, cylindrical body having a cable end and a connector end and third and fourth coaxial internal bores of different diameter, such that said third bore of smaller diameter extends a preselected depth into said second body from said connector end and said fourth bore of larger diameter extends a preselected depth into said second body from said cable end, a second internal body shoulder being formed where said third and fourth bores meet;

a second cylindrical metal pin, concentrically positioned within said second body, said second pin having a length substantially greater than the diameter thereof and an undercut of preselected length formed thereupon at a preselected location along the length thereof thereby forming third and fourth pin shoulders, and further having a third tapered end and a hollow end, said hollow end being recessed within said first body connector end and said third pin shoulder aligning with said second body shoulder, for providing an electrically conducting path therethrough;

a second fused glass cylindrical insert, having a preselected thickness, a cable end surface, a connector end surface and a dielectric constant, said second insert being heat fused to said fourth bore, said second body shoulder and said second pin undercut, for providing axial open-face pressure strength and hermetically sealing said receptacle means;

a third cylindrical plastic insulator, press fit on said connector end of said second pin and contacting the periphery of said third bore and the connector end surface of said second insert;

a second metal sleeve, slideably engaging said third tapered end of said second metal pin and soldered to the central conductor of said coaxial connector, for providing electrical conduction therebetween;

a fourth cylindrical plastic insulator, positioned within said second body over said second sleeve and contacting said fourth bore, contacting the cable end surface of said second insert and contacting the cable dielectric, for providing an impedance matching that of said cable; and a second tapered metal adapter, inserted within and fixedly attached to said fourth bore and being soldered to the outer metal braid of said coaxial cable, for providing support for said braid and electrical conductivity.

* * * * *